US007336141B2

(12) United States Patent
Mueller

(10) Patent No.: US 7,336,141 B2
(45) Date of Patent: Feb. 26, 2008

(54) JUNCTION WITH STEPPED STRUCTURES BETWEEN A MICROSTRIP LINE AND A WAVEGUIDE

(75) Inventor: Thomas Mueller, Erbach-Bach (DE)

(73) Assignee: EADS Deutschland GmbH, Ottobrunn (DE)

( * ) Notice: Subject to any disclaimer, the term of this patent is extended or adjusted under 35 U.S.C. 154(b) by 55 days.

(21) Appl. No.: 10/528,431

(22) PCT Filed: Jul. 30, 2003

(86) PCT No.: PCT/DE03/02553

§ 371 (c)(1),
(2), (4) Date: Dec. 15, 2005

(87) PCT Pub. No.: WO2004/030142

PCT Pub. Date: Apr. 8, 2004

(65) Prior Publication Data

US 2006/0145777 A1 Jul. 6, 2006

(30) Foreign Application Priority Data

Sep. 20, 2002 (DE) ..... 102 43 671

(51) Int. Cl.
*H01P 5/107* (2006.01)

(52) U.S. Cl. ..... 333/26; 333/34

(58) Field of Classification Search ..... 333/26, 333/34

See application file for complete search history.

(56) References Cited

U.S. PATENT DOCUMENTS 4,754,239 A * 6/1988 Sedivec ..... 333/26

6,265,950 B1 * 7/2001 Schmidt et al. ..... 333/26

FOREIGN PATENT DOCUMENTS

| | | |
|---|---|---|
| JP | 05090807 | 4/1993 |
| JP | 05283915 | 10/1993 |
| JP | 2002111312 | 4/2002 |

OTHER PUBLICATIONS

K. Sano et al., *A Transition from Microstrip to Dielectric-Filled Rectangular Waveguide in Surface Mounting*, 2002 IEEE MTT-S International Microwave Digest.

* cited by examiner

*Primary Examiner*—Benny Lee
(74) *Attorney, Agent, or Firm*—Crowell & Moring LLP

(57) ABSTRACT

An arrangement for a junction between a microstripline and a waveguide is provided. The arrangement includes a microstripline fitted on the upper face of a dielectric substrate, a waveguide fitted on the upper face of the substrate and has an opening on at least one end surface and has a structure which is in the form of a step or steps in the area of the opening on one side wall and is conductively connected in at least one part to a microstripline. One side wall of the waveguide is a metallized layer formed on the substrate. A cutout is formed in the metallized layer and into which the microstripline projects. A rear-face metallization is formed on the rear face of the substrate, and electrically conductive via holes between the metallized layer on the upper face of the substrate and the rear-face metallization, which surround the cutout.

11 Claims, 4 Drawing Sheets

JUNCTION WITH STEPPED STRUCTURES BETWEEN A MICROSTRIP LINE AND A WAVEGUIDE

BACKGROUND AND SUMMARY OF THE INVENTION

In many extra-high frequency technology applications, in particular for millimetric wave technology, it is necessary to inject a wave which has been carried in a microstripline into a waveguide, and vice versa. In this case, the junction should be as free of reflections and losses as possible. This junction ensures, within a limited frequency range, that the impedances between the waveguide and the stripline are matched to one another, and that the field pattern of the first waveguide type is transferred to the field pattern of the other waveguide type.

Microstripline/waveguide junctions are known, for example, from DE 197 41 944 A1 or U.S. Pat. No. 6,265,950 B1.

Figure 1:
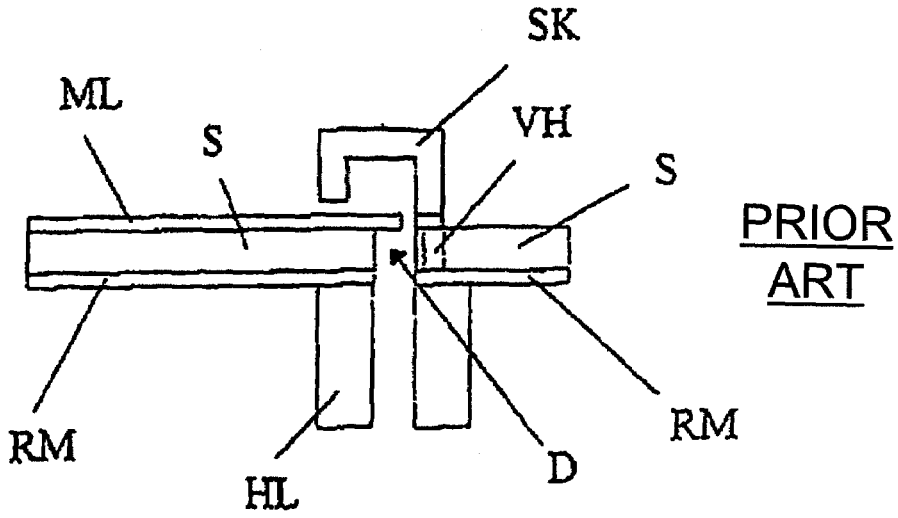

DE 197 41 944 A1 describes an arrangement in which the microstripline is applied to the upper face of the substrate (FIG. 1). An end surface of the waveguide HL is fitted on the lower face of the substrate S. The substrate S has an aperture D in the area of the waveguide HL. The aperture D corresponds essentially to the cross section of the waveguide HL. A coupling element (not illustrated) is arranged on the microstripline ML and projects into the aperture D. The aperture D is surrounded on the upper face of the substrate S by a screening cap SK, which is electrically connected by means of electrically conductive drilled holes (via holes) VH to the metallization RM on the lower face of the substrate S.

This arrangement has the disadvantage that the printed circuit board must be mounted conductively on a prepared mounting plate containing the waveguide HL. In addition, a precision manufactured shielding cap SK, which is mechanically positioned with precision and must be applied conductively, is required. The production of this arrangement is time-consuming and costly due to the large number of different types of processing steps. Further disadvantages result from the large amount of space required as a result of the waveguide being arranged outside the printed circuit board.

In the arrangement described in U.S. Pat. No. 6,265,950 B1 for a junction between a microstripline and a waveguide, the substrate with the microstripline applied to it projects into the waveguide. One disadvantage of this arrangement is the integration of the waveguide in a printed circuit board environment. The waveguide can be arranged only on the boundary surfaces of the printed circuit board (substrate). The waveguide cannot be integrated within the printed circuit board, because of the costly preparation of the printed circuit board.

The object of the invention is to specify an arrangement for a junction between a microstripline and a waveguide, which can be produced easily and at low cost and which occupies only a small amount of space.

The arrangement according to the invention for a junction between a microstripline and a waveguide comprises:

- a microstripline which is fitted on the upper face of a dielectric substrate,
- a waveguide which is fitted on the upper face of the substrate and has an opening on at least one end surface and has a structure which is in the form of a step or steps in the area of the opening on one side wall and is conductively connected in at least one part to the microstripline, and wherein one side wall of the waveguide is a metallized layer formed on the substrate,
- a cutout which is formed in the metallized layer and into which the microstripline projects,
- rear-face metallization which is formed on the rear face of the substrate, and
- electrically conductive via holes between the metallized layer on the upper face of the substrate and the rear-face metallization, which surround the cutout.

One advantage of the arrangement according to the invention is that the microstrip/waveguide junction can be produced easily and at low cost. The production of the junction requires fewer components than the prior art. A further advantage is that the implementation of the waveguide in the printed circuit board environment need not be at the edge of the printed circuit board as in the case of the U.S. Pat. No. 6,265,950 but can be provided at any desired point on the printed circuit board. The arrangement according to the invention thus occupies little space.

The waveguide is advantageously a surface mounted device. The waveguide part is for this purpose fitted to and conductively connected to the printed circuit board from above in a single fitting step. The connection of the waveguide to the junction can thus be integrated in known component placement methods. This saves manufacturing steps, thus reducing the production costs and time.

BRIEF DESCRIPTION OF THE DRAWING FIGURES

Figure 2:
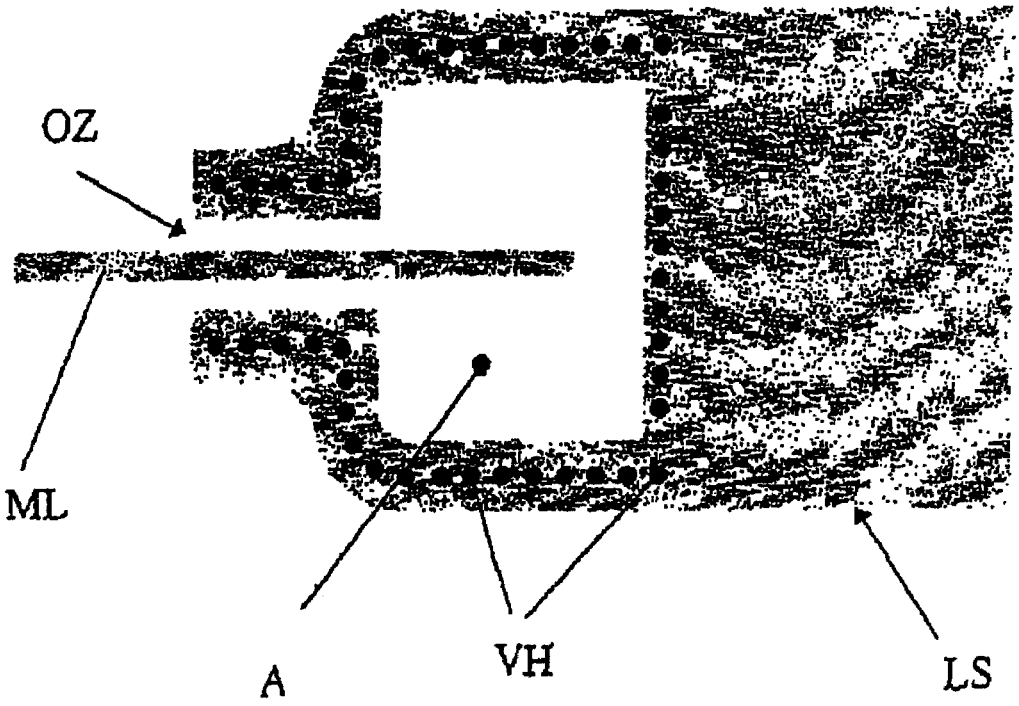
Figure 3:
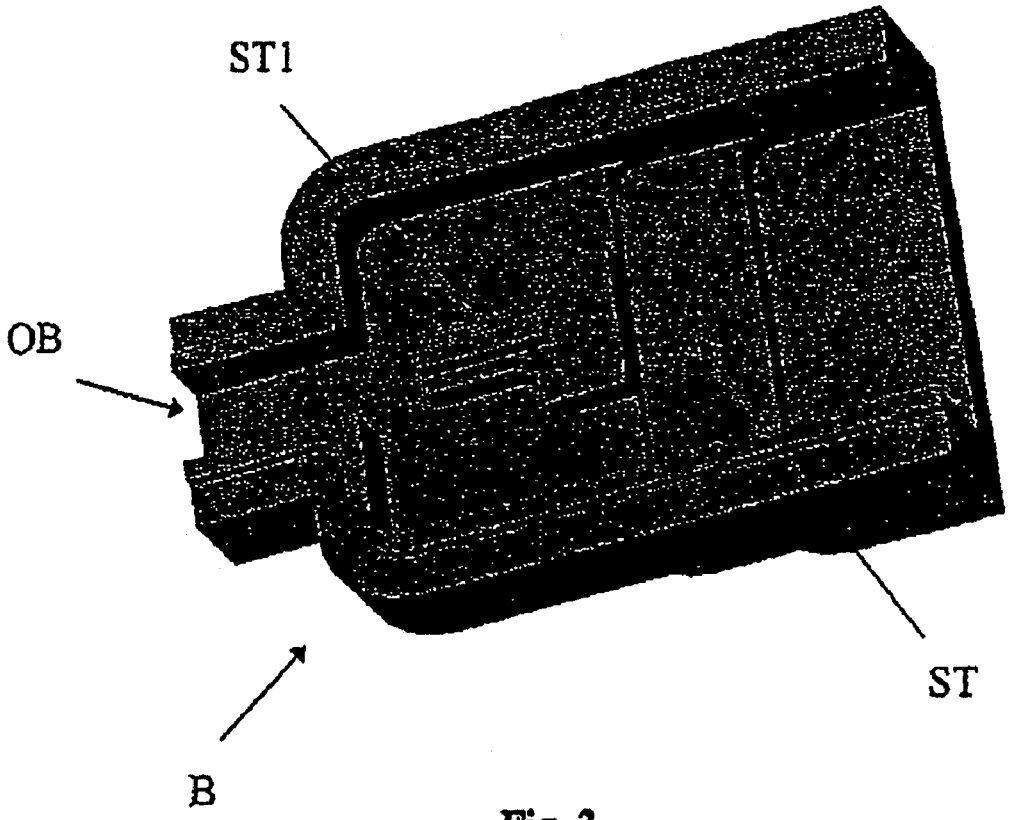
Figure 4:
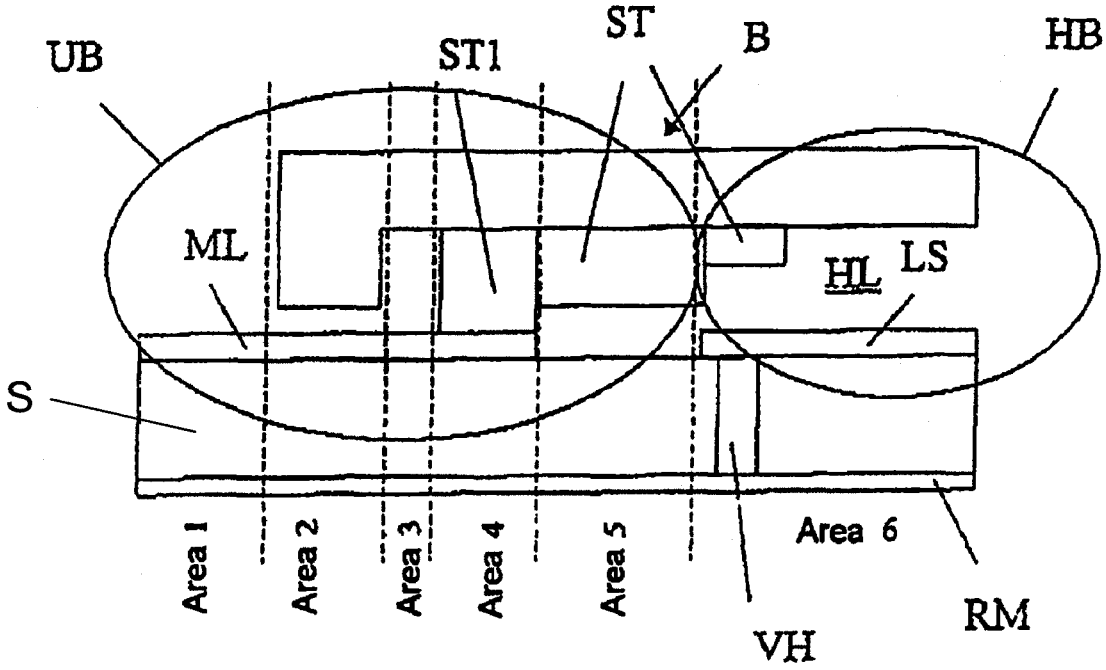
Figure 5:
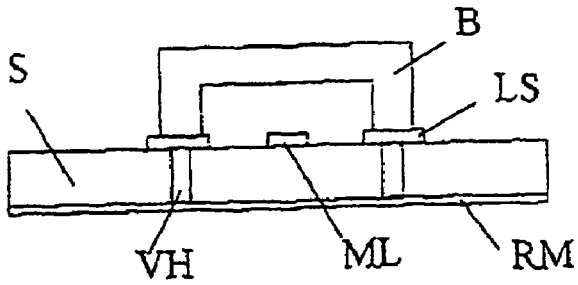
Figure 6:
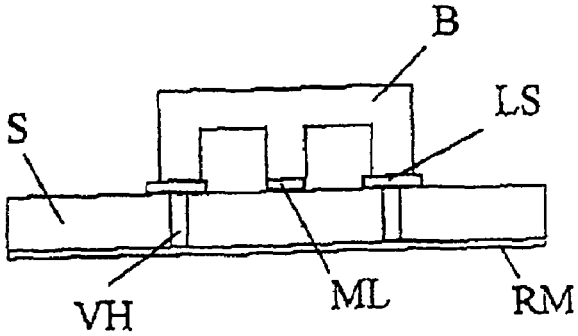
Figure 7:
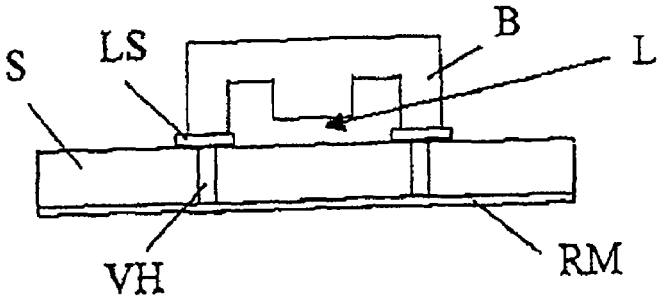
Figure 8:
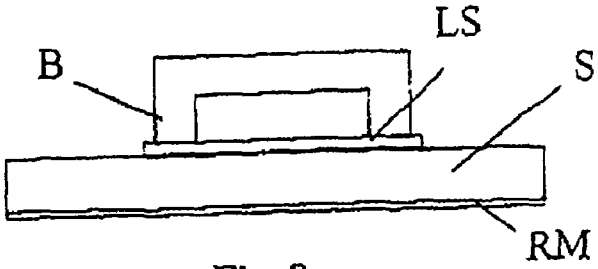
Figure 9:
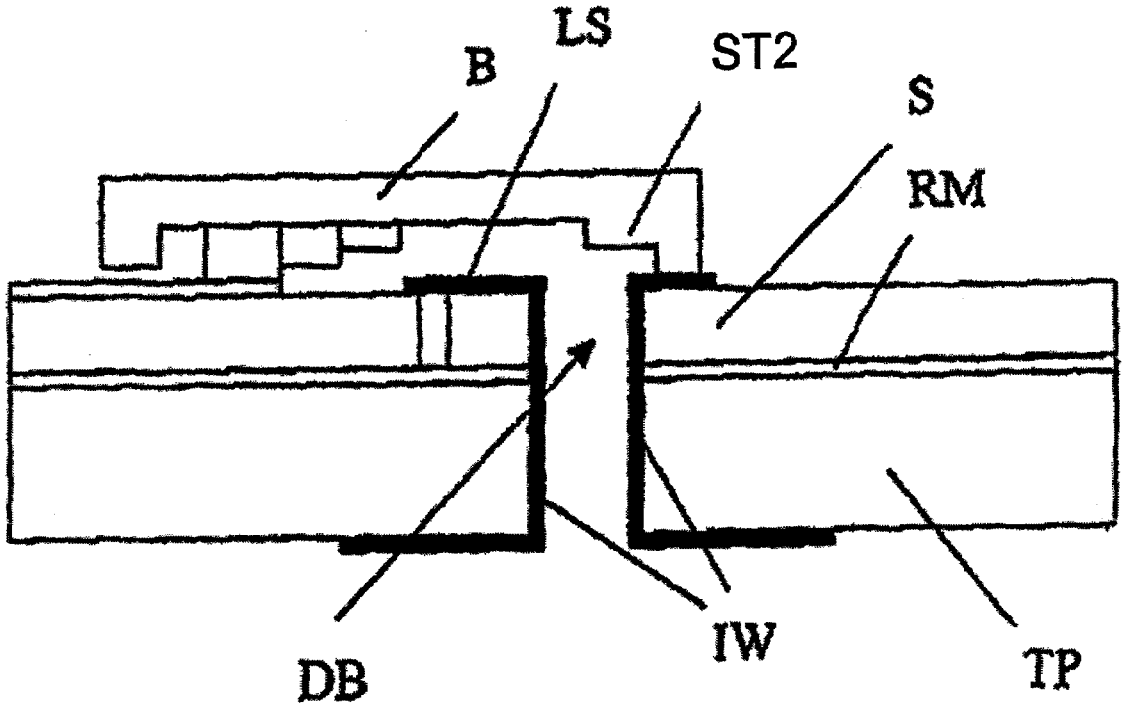

The invention as well as further advantageous refinements of the arrangement according to the invention will be explained in more detail in the following text with reference to the drawings, in which:

FIG. 1 shows a longitudinal section through an arrangement for a microstrip/waveguide junction according to the prior art, FIG. 2 shows a plan view of the metallized layer on the upper face of the substrate, FIG. 3 shows a perspective view of an example of an internal structure, which is in the form of a step or steps, for the surface mounted device, FIG. 4 shows a longitudinal section through an arrangement according to the invention for a microstrip/waveguide junction, FIG. 5 shows a first cross section through the area 3 in FIG. 4, FIG. 6 shows a second cross section through the area 4 in FIG. 4, FIG. 7 shows a third cross section through the area 5 in FIG. 4, FIG. 8 shows a fourth cross section through the area 6 in FIG. 4, and FIG. 9 shows a further advantageous embodiment of the microstrip/waveguide junction according to the invention.

DETAILED DESCRIPTION OF THE PREFERRED EMBODIMENTS

FIG. 2 shows a plan view of the metallized layer of the substrate. This metallized layer is also referred to as a land structure for the microstrip/waveguide junction. The land structure LS has a cutout A with an opening OZ. The microstripline ML runs through this opening OZ and ends within the cutout A. The cutout A is surrounded by via holes VH. These via holes VH are electrically conductive apertures in the substrate, connecting the land structure LS to the rear-face metallization (not illustrated) on the rear face of the substrate. The distance between the via holes VH is chosen to be sufficiently short that the radiated emission of the electromagnetic wave through the intermediate spaces is minimized within the useful frequency range. The via holes VH may in this case advantageously also run in a number of rows, which are arranged parallel to one another, in order to reduce the radiated emission.

FIG. 3 shows a perspective illustration of an example of an internal structure, which is in the form of a step or steps, for the surface mounted device. The component B likewise has an opening OB, corresponding to the opening in the cutout in the land structure (see FIG. 2). A structure ST1, ST, which is in the form of a step or steps or steps, is formed in the longitudinal direction of the component, at a distance which can be predetermined from the opening OB on the side wall. That side wall of the component B which contains the stepped structure ST1 and ST is opposite the substrate surface after installation of the land structure LS (see FIG. 4). The waveguide component B to be fitted is open at the bottom (in the direction of the substrate) before being fitted, and is thus still incomplete. The side wall which is still missing is formed by the land structure LS on the substrate.

The arrangement according to the invention is, furthermore, not restricted by the number of steps illustrated in FIG. 3 or FIG. 4. The number, length and width of the individual steps in the structure ST can be matched to the respective requirements of the junction. It is, of course, also possible to provide a continuous junction.

In FIGS. 3 and 4, the step annotated with the reference symbol ST1 is of such a height that, when the component B is fitted to the land structure as shown in FIG. 4 in an interlocking manner, the step ST1 rests directly on the microstripline ML, thus making an electrically conductive connection between the microstropline ML and the component B.

FIG. 4 shows a longitudinal section through an arrangement according to the invention of a microstrip/waveguide junction. In this case, the component B as shown in FIG. 3 is fitted in an interlocking manner to the land structure of the substrate S as shown in FIG. 4 The component B is in this case fitted, in particular, to the substrate in such a way that an electrically conductive connection is made between the land structure and the component B.

On the lower face, the substrate S has an essentially continuous metallic coating RM. The waveguide area is designated by reference symbol HB and the junction area is designated by reference symbol UB.

The microstrip/waveguide junction according to the invention operates on the following principle: the radio-frequency signal outside the waveguide HL is passed through a microstripline ML with the impedance $Z_0$ (area 1). The radio-frequency signal within the waveguide HL is carried in the form of the TE10 basic waveguide mode. The junction UB converts the field pattern of the microstrip mode in steps to the field pattern of the waveguide mode. At the same time, by virtue of the steps in the component B the junction UB transforms the characteristic impedance and ensures that the impedance $Z_0$ is matched, within the useful frequency range, to the impedance $Z_{HL}$ of the waveguide HL. This allows a low-loss and low-reflection junction between the two waveguides.

First of all, the microstripline ML leads into the area 2 of a so-called cutoff channel. This channel is formed from the component B, the rear-face metallization RM and the via holes VH, which create a conductive connection between the component B and the rear-face metallization RM. The width of the cutoff channel is chosen such that no additional wave type other than the signal-carrying microstrip mode can propagate in this area 2. The length of the channel determines the attenuation of the undesirable waveguide mode which cannot propagate, and prevents radiated emissions into free space (area 1).

In the area 3, the microstripline ML is located in a type of partially filled waveguide. The waveguide is formed from the component B, the rear-face metallization RM and the via holes VH (FIG. 5). The structure of the component B, which is in the form of a step or steps or steps, is connected in the area 4 to the microstripline ML (FIG. 6). The side walls of the component B are conductively connected to the rear face metallization RM of the substrate S by means of a socalled shielding row of via holes VH.

This results in the formation of a dielectrically loaded ridge waveguide. The signal energy is concentrated between the rear-face metallization RM and the ridge which is formed from the microstripline ML and that of the step ST1 of the component B.

In comparison to the area 4, the height of the stepped structure ST contained in the component B decreases in the area 5, so that a defined air gap L is formed between the substrate material and the stepped structure ST when the component B is connected in an interlocking manner to the land structure LS on the substrate S (FIG. 7). The side walls of the component B are conductively connected to the rear-face metallization RM through via holes VH. This results in a partially filled, dielectrically loaded ridge waveguide.

The width of the step widens for the purpose of gradually matching the field pattern from area 4 to the field pattern of the waveguide mode (area 6). The length, width and height of the steps are chosen such that the impedance of the microstrip mode Zo is transformed to the impedance of the waveguide mode ZHL at the end of the area 6. If required, the number of steps in the structure of the component B in the area 5 can also be increased, or a continuously tapered ridge may be used.

The area 6 illustrates the waveguide area HB. The component B forms the side walls and the cover of the waveguide HL. The waveguide base is formed by the land structure LS on the substrate S (FIG. 8) that is to say, in comparison to the area 5, there is now no dielectric filling in the waveguide HL.

One or more shielding rows of via holes VH in the junction area between the area 5 and the area 6, which run transversely with respect to the propagation direction of the wave in the waveguide, provide the junction between the partially dielectrically filled waveguide and the purely air-filled waveguide. At the same time, these shielding rows prevent the signal from being injected between the land structure LS and the rear-face metallization.

A stepped structure (analogous to the stepped structure in the area 5) can optionally also be provided in the area 6 in the cap upper part.

The length and height of these steps is chosen analogously to the area 5, so that, in combination with the other areas, the impedance of the microstrip mode $Z_0$ is transformed to the impedance $Z_{HL}$ for the waveguide mode at the end of the area 6.

FIG. 9 shows a further advantageous embodiment of the microstrip/waveguide junction according to the invention. The microstrip/waveguide junction includes land structure LS, substrate S, rear-face metallization RM, a component B with a stepped shape ST2, wave guide opening DB, internal walls IW and support material TP. This embodiment makes it possible to provide a simple and low-cost waveguide junction in which the radio-frequency signal can be output through the substrate S downwards through the continuous waveguide opening DB which is contained in the substrate. The waveguide opening DB advantageously has electrically conductive internal walls (IW). The component B advantageously has a stepped shape ST2 in the area of the aperture DB on the side wall opposite the waveguide opening DB. This stepped shape ST2 deflects the wave in the waveguide through 90° from the waveguide area HB of the component B into the waveguide opening DB in the substrate S. A further waveguide or a radiating element, for example, can be arranged on the lower face of the substrate S, in the area of the waveguide opening DB. In the present example shown in FIG. 9, a further support material TP, for example a printed circuit board having one or more layers or a metal mount, is fitted to the rear-face metallization RM. In comparison to DE 197 41 944 A1, the advantage of this arrangement is the simplified, more cost-effective design of the substrate S and of the support material TP. The waveguide opening is milled all the way through, and the internal walls are electrochemically metallized. Both process steps are standard processes which are normally used in printed circuit board technology and can be carried out easily.

The invention claimed is:

1. An arrangement for a junction between a microstripline and a waveguide, comprising:

a microstripline which is fitted on an upper face of a dielectric substrate;

a waveguide which is fitted on the upper face of the substrate and has an opening on at least one end surface thereof and has a structure which is in the form of a step or steps in the area of the opening on one side wall and is conductively connected in at least one part to the microstripline, and wherein the one side wall of the waveguide is a metallized layer disposed on the substrate;

a cutout which is disposed in the metallized layer and into which the microstripline projects;

rear-face metallization which is disposed on a rear face of the substrate; and electrically conductive via holes between the metallized layer on the upper face of the substrate and the rear-face metallization, which surround the cutout.

2. The arrangement as claimed in claim 1, wherein the structure which is in the form of a step or steps is disposed on a second side wall of the waveguide which is opposite the cutout.

3. The arrangement as claimed in claim 2, wherein the cutout has a waveguide opening in the area of the metallized layer on the upper face of the substrate.

4. The arrangement as claimed in claim 1, wherein a distance between the via holes is chosen such that the radiated emission of an electromagnetic wave in the useful frequency range through intermediate spaces is small, and the operation of the junction is thus not adversely affected by increased losses or undesirable couplings.

5. The arrangement as claimed in claim 4, wherein the via holes run in a number of rows which are arranged parallel to one another.

6. The arrangement as claimed in claim 5, wherein a second side wall of the waveguide which is opposite the upper face of the substrate has the structure, which is in the form of the step or steps, in the area of the waveguide opening.

7. The arrangement as claimed in claim 5, wherein an inner surface of the waveguide opening is electrically conductive.

8. The arrangement as claimed in claim 1, wherein the cutout has a waveguide opening in the area of the metallized layer on the upper face of the substrate.

9. The arrangement as claimed in claim 8, wherein a second side wall of the waveguide which is opposite the upper face of the substrate has a structure, which is in the form of the step or steps, in the area of the waveguide opening.

10. The arrangement as claimed in claim 1, wherein the waveguide is a surface mounted device.

11. The arrangement as claimed in claim 9, wherein the structure which is in the form of a step or steps is disposed on a second side wall of the wave guide which is opposite the cutout.

* * * * *